US006390868B1

(12) United States Patent
Nakamura et al.

(10) Patent No.: US 6,390,868 B1
(45) Date of Patent: May 21, 2002

(54) TILT DEVICE FOR MARINE PROPULSION UNIT

(75) Inventors: Tamotsu Nakamura; Shinsuke Sekikawa, both of Saitama (JP)

(73) Assignee: Showa Corporation (JP)

( * ) Notice: Subject to any disclaimer, the term of this patent is extended or adjusted under 35 U.S.C. 154(b) by 0 days.

(21) Appl. No.: 09/793,297

(22) Filed: Feb. 26, 2001

(30) Foreign Application Priority Data

Jun. 23, 2000 (JP) ..... 2000-190118

(51) Int. Cl.[7] ..... B63H 5/125
(52) U.S. Cl. ..... 440/61
(58) Field of Search ..... 440/61, 55, 56

(56) References Cited

U.S. PATENT DOCUMENTS 5,876,259 A * 3/1999 Nakamura ..... 440/56

FOREIGN PATENT DOCUMENTS

JP 2945071 * 6/1999

* cited by examiner

*Primary Examiner*—Ed Swinehart
(74) *Attorney, Agent, or Firm*—Orum & Roth

(57) ABSTRACT

In a tilt device for a marine propulsion unit, a cylinder is constituted by a double pipe having an outer cylinder and an inner cylinder, a rod guide sealing the outer cylinder and the inner cylinder is provided at an end portion of the cylinder, a free piston is arranged in a space between the outer cylinder and the inner cylinder, a liquid discharging chamber is formed in a rod guide side from the free piston of the space, and an absorber valve which can be opened at a time when a pressure of a fluid in the rod side chamber is increased to a level equal to or more than a predetermined value and can feed the fluid in the rod side chamber to the liquid discharging chamber and a return valve which can feed the fluid in the liquid discharging chamber to the rod side chamber are provided in the rod guide.

8 Claims, 7 Drawing Sheets

TILT DEVICE FOR MARINE PROPULSION UNIT

BACKGROUND OF THE INVENTION

1. Field of the Invention

The present invention relates to a tilt device for a marine propulsion unit.

2. Description of the Related Art

There is a structure described in Japanese Patent No. 2945071 as a tilt device with a gas assist function for assisting a tilt up load applied to a main body of a propulsion unit by a gas pressure in a pressure accumulating chamber.

The tilt device is structured such that a piston is fixed to the piston rod inserted to the cylinder. The inner portion of the cylinder is separated into a rod side chamber and a piston side chamber by the piston. A switching valve for communicating the rod side chamber with the piston side chamber and an operating portion thereof are provided in a side portion of the cylinder. A pressure accumulating chamber for applying a gas pressure for a gas assist to the piston side chamber is arranged within the cylinder and on the piston side chamber. Accordingly, the gas pressure in the pressure accumulating chamber is applied to both sides of the piston via a working fluid when opening the switching valve, whereby the gas assist force corresponding to a cross sectional area of the rod can be generated in a tilting up direction.

Further, an absorber valve can be opened when the fluid pressure in the rod side chamber is increased to a level equal to or more than a predetermined value in order to absorb an impact force applied to the propulsion unit main body. When a collision with drifting wood occurs, the fluid in the rod side chamber can be discharged and a return valve can return the temporarily discharged fluid mentioned above from the absorber valve to the rod side chamber. This series of events will return the propulsion unit main body after rising up. The absorber valve, rod side chamber and return valve are provided in the piston. Further, a free piston for coinciding the return position of the propulsion unit main body after rising up with a staying position before rising up is provided in the piston close to the piston side chamber, whereby it is possible to form a liquid discharging chamber for the fluid discharged from the absorber valve between the piston and the free piston.

(1) Since the absorber valve and the return valve are provided in the piston, it is hard to make the diameter of the piston small and further, it is unavoidable that the cylinder is enlarged.

(2) Since the pressure accumulating chamber is within the single cylinder type cylinder and on the piston side chamber, in a recessed portion in a side of the closed end of the cylinder, it is hard to increase a capacity of the pressure accumulating chamber.

(3) Since the switching valve and the operating portion thereof are provided in the side portion of the cylinder, the lateral size of the tilt device becomes too large.

SUMMARY OF THE INVENTION

An object of the present invention is to provide a tilt device for a marine propulsion unit with a gas assist function which can increase the capacity of the pressure accumulating chamber while being compact and can secure a rising up performance of a propulsion unit main body caused by a collision of drifting wood.

In accordance with the present invention, the tilt device for a marine propulsion unit contains a cylinder connected to one of a hull and a main body of a propulsion unit and receiving a working fluid, and a piston rod connected to another and inserted into the cylinder so as to freely compress and expand. A piston connected to an inserted end to the cylinder of the piston rod and defines a rod side chamber in the receiving side of a piston rod and a piston side chamber in a non-receiving side of the piston rod within the cylinder. A switching valve which is capable of communicating the rod side chamber with the piston side chamber, and a pressure accumulating chamber capable of applying a gas pressure to the piston side chamber are contained in the marine propulsion unit. The cylinder is constituted by a double pipe which has an outer cylinder and an inner cylinder, and receives the piston rod and the piston in the inner cylinder. The outer cylinder and the inner cylinder are sealed at an end portion of the cylinder, a rod guide supporting the piston rod is provided, a free piston is arranged in a space between the outer cylinder and the inner cylinder, the pressure accumulating chamber is formed in an opposite rod guide side to the free piston in said space, and a liquid discharging chamber is formed in a rod guide side. An absorber valve which can be opened when the fluid pressure in the rod side chamber is increased to a level equal to or more than a predetermined value can feed the fluid in the rod side chamber to the liquid discharging chamber. A return valve which can be opened when the pressure of the fluid in the liquid discharging chamber is increased to a level equal to or more than a predetermined value can feed the fluid in the liquid discharging chamber to the rod side chamber are provided in the rod guide.

BRIEF DESCRIPTION OF THE DRAWINGS

The present invention will be more fully understood from the detailed description given below and from the accompanying drawings which should not be taken to be a limitation on the invention, but are for explanation and understanding only. The drawings

DESCRIPTION OF THE PREFERRED EMBODIMENTS

Figure 1:
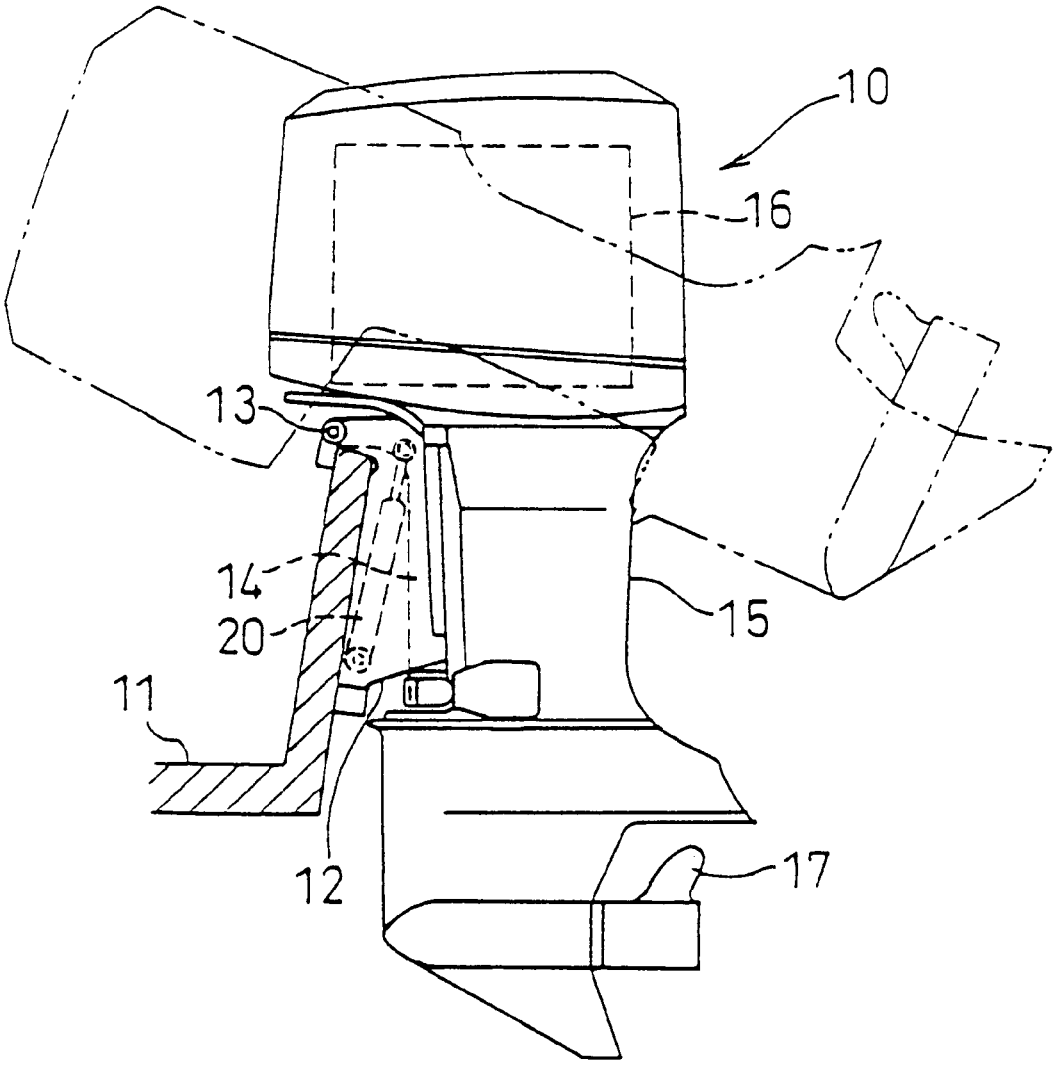
FIG. 1 is a schematic view showing a marine propulsion unit.
Figure 2:
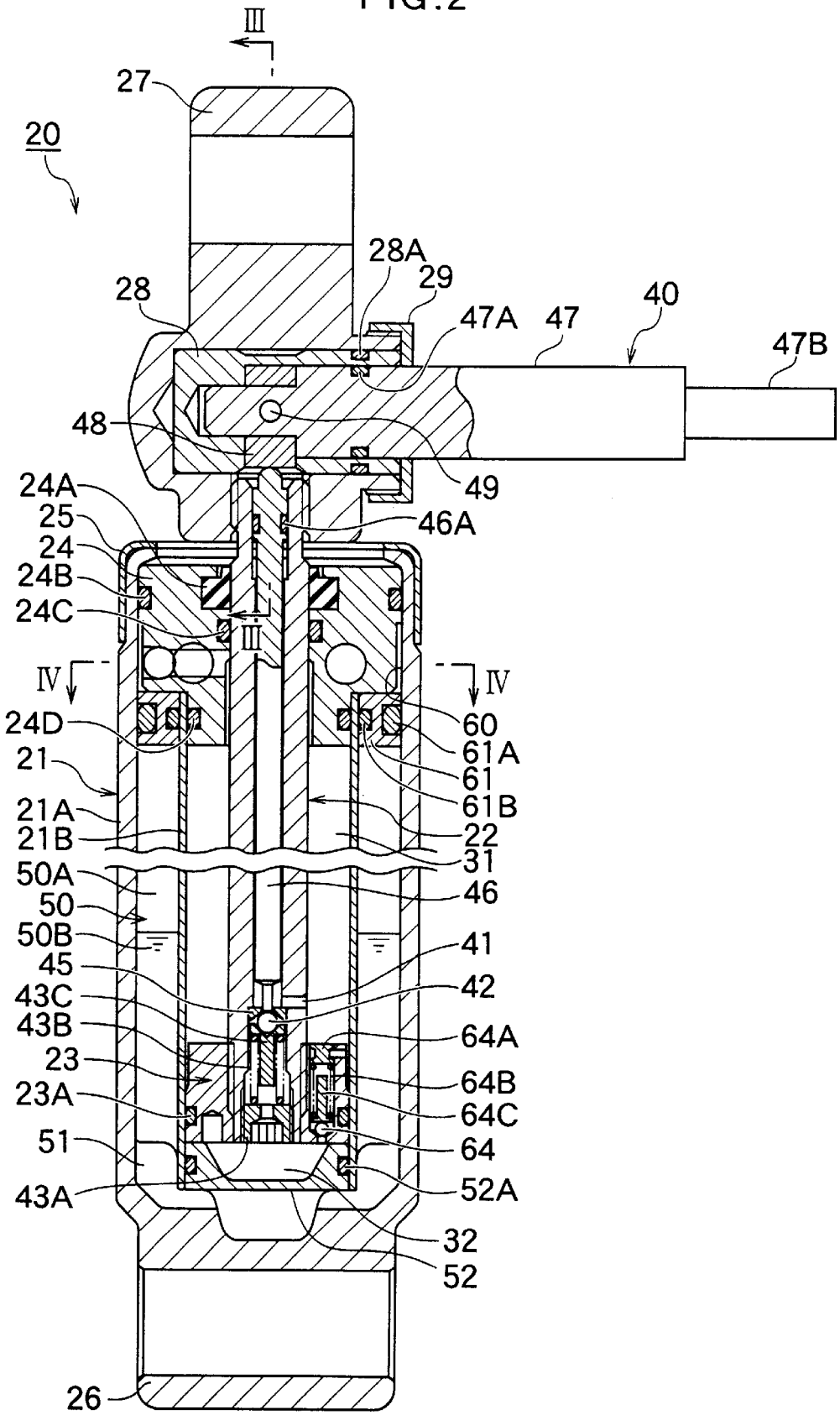
FIG. 2 is a cross sectional view of a main portion showing a tilt device in accordance with a first embodiment.

A marine propulsion unit 10 is, for example, an outboard motor (or an inboard outboard motor) mounted to a hull 11, as shown in FIG. 1, and is structured such that a clamp bracket 12 is fixed to the hull 11 and a swivel bracket 14 is pivoted to the clamp bracket 12 via a tilt shaft 13. A propulsion unit main body 15 of the marine propulsion unit 10 is pivoted to the swivel bracket 14 via a steering shaft (not shown). An engine unit 16 is mounted on an upper portion of the propulsion unit main body 15 and a propeller 17 is provided in a lower portion of the propulsion unit main body 15. The marine propulsion unit 10 is held at a down position by a tilt device 20 mentioned below, and normally or reverse rotates the propeller 17 in accordance with an operation of the engine unit 16 so as to move hull 11 forward or rearward.

The tilt device 20 is structured, as shown in FIGS. 2 to 8, such that a mounting portion 26 provided in the cylinder 21 is connected by a pin to one of the clamp brackets 12 and the swivel bracket 14, to the damp brackets 12 in the present embodiment. A mounting portion 27 is screwed and attached to a piston rod 22 inserted to the cylinder 21 so as to freely expand and compress is connected by a pin to another of the clamp bracket 12 and the swivel bracket 14; to. the swivel bracket 14 in the present embodiment. A piston 23 is fixed to an inserted end to the cylinder 21 of the piston rod 22. The cylinder 21 is constituted by a double pipe (a complex cylinder structure) having an outer cylinder 21A and an inner cylinder 21B and is structured such that the outer cylinder 21A and the inner cylinder 21B are sealed at an end portion of the cylinder 21. A rod guide 24 for supporting the piston rod 22 is provided. That is, the structure is made such that the inner cylinder 21B and the rod guide 24 are held in an inner portion of the outer cylinder 21A by abutting one end portion of the inner cylinder 21B to a recess portion in a closed end of the casting outer cylinder 21A. Another end portion of the inner cylinder 21B is fitted to a small diameter portion at an inner end of the rod guide 24 fitted to an opening portion of the outer cylinder 21A and caulking and holding the rod guide 24 by an outer end portion of the outer cylinder 21A. Reference numeral 24A denotes an oil seal, and reference numerals 24B to 24D denote an O-ring. Reference numeral 25 denotes a cap.

The piston rod 22 and the piston 23 are received within the inner cylinder 21B of the cylinder 21. The piston 23 defines a rod side chamber 31 in a side which receives the piston rod 22 and a piston side chamber 32 in a side which does not receive the piston rod 22 in an inner portion of the inner cylinder 21B. The rod side chamber 31 and the piston side chamber 32 receive an oil as a working fluid. Reference numeral 23A denotes an O-ring.

Figure 3:
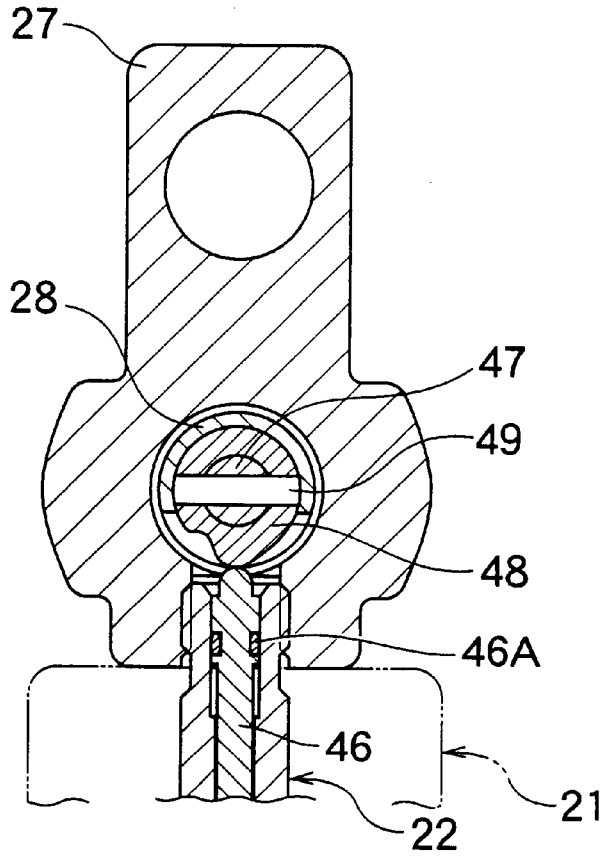
FIG. 3 is a cross sectional view along a line III—III in FIG. 2.

The tilt device 20 has a tilt operating apparatus 40 which makes it possible to tilt the propulsion unit 15 between a tilt down position and a tilt up position in accordance with a manual operation. The tilt operating apparatus 40 pierces a communicating passage 41 for communicating the piston side chamber 32 with the rod side chamber 31 in the inserting end side to the inner cylinder 21B of the piston rod 22, and is provided with a switching valve 42 in the communicating passage 41. The switching valve 42 is pressed to a valve seat 45 disposed in a middle portion of the communicating passage 41 by a spring 43B backed up by a spring bearing 43A attached to an opening of the communicating passage 41 in the side of the piston side chamber 32, and a spring holder 43C so as to close the communicating passage 41. A switching operation rod 46 is inserted to a center portion of the piston rod 22 from an external portion so as to be installed therein. A front end small diameter portion of the switching operation rod 46 abuts the switching valve 42, and a base end portion of the switching operation rod 46 abuts a cam 48 of an operating portion 47 provided in a bearing portion 28 mounted to the mounting portion 27 attached to a portion protruding outward from the cylinder 21 of the piston rod 22 (FIG. 3). Reference numeral 29 denotes a cap, reference numeral 28A denotes an O-ring, reference numerals 46A and 47A denote an O-ring, and reference numeral 49 denotes a connecting pin. The switching operation rod 46 is switched and set to a closing operation position (an upper end position) of the communicating passage 41 by the switching valve 42 and an opening operation position (a lower end position) by rotating the cam 48 of the operating portion 47 by means of a handle engaged and attached to a handle engaging portion 47B of the operating portion 47, thereby opening and closing the switching valve 42 against an elastic force of the spring 43B.

The tilt device 20 has a pressure accumulating chamber 50 capable of applying a gas pressure to the piston side chamber 32, for the purpose of assisting a tilt-up load applied to the propulsion unit main body 15. This occurs when communicating the rod side chamber 31 with the piston side chamber 32 in accordance with: an opening operation of the switching valve 42 of the tilt operating apparatus 40 so as to manually tilt the propulsion unit main body 15. In the present embodiment, an annular space between the outer cylinder 21A and the inner cylinder 21B and a bottom side space of the inner cylinder 21B communicated with the annular space by a communicating passage 51 form a series of pressure accumulating chambers 50 in the inner portion of the cylinder 21. A free piston 52 constituting gas-liquid separating means is arranged between the pressure accumulating chamber 50 and the piston side chamber 32 in the inner portion of the inner cylinder 21B. Reference numeral 52A denotes an O-ring. The pressure accumulating chamber 50 may be wholly formed as a gas chamber 50A, however, in accordance with the present embodiment, the structure is made such that an oil chamber 50B is provided in a lower portion of the gas chamber 50A and the whole of the gas chamber 50A and the oil chamber 50B constitutes the pressure accumulating chamber 50. The pressure accumulating chamber 50 applies a gas pressure generated in the gas chamber 50A when opening the switching valve 42 of the tilt operating apparatus 40 to both sides of the piston 23 via the working fluid, and reduces the tilt-up load by an assist force obtained by multiplying a cross sectional area of the piston rod 22 by the gas pressure. The cross sectional area corresponds to a difference between both side pressure receiving areas of the piston 23. Further, the pressure accumulating chamber 50 compensates a capacity change of the rod side chamber 31 and the piston side chamber 32 caused in accordance with forward and rearward movements of the piston rod 22 with respect to the rod side chamber 31 and the piston side chamber 32 of the cylinder 21, on the basis of expansion and compression of the gas chamber 50A (upward and downward movements of the free piston 52).

Figure 4:
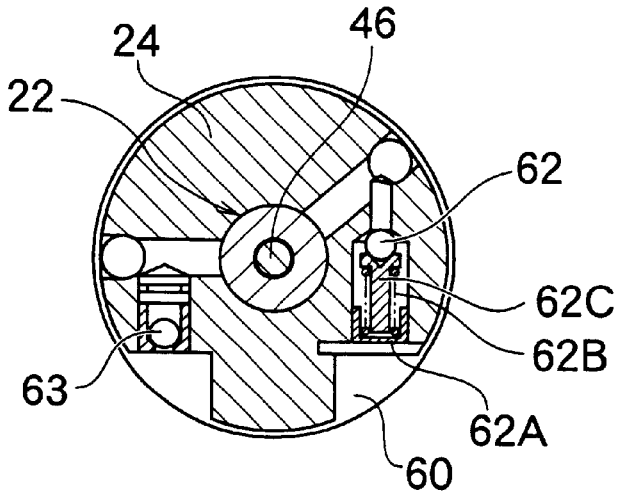
FIG. 4 is a cross sectional view along a line IV—IV in FIG. 2.

The tilt device 20 has the following structure in order to secure a rising up performance of the propulsion unit main body 15 due to collision with an obstacle such as drifting wood or the like. In accordance with the present embodiment, the structure is made such that a free piston 61 is arranged in an annular space between the outer cylinder 21A and the inner cylinder 21B of the cylinder 21. An opposite side of the rod guide 24 with respect to the free piston 61 in the annular space forms the pressure accumulating chamber 50, and a side of the rod guide 24 forms a liquid discharging chamber 60. Reference numerals 61A and 61B denote an O-ring. Further, an absorber valve 62 (a spring bearing 62A, a spring 62B and a spring holder 62C) and a return valve 63 are provided in the rod guide 24 (FIG. 4). The absorber valve 62 can be opened when the oil in the rod side chamber 31 is increased to a level equal to or more than a predetermined value such as under application of an impact force generated by collision with an obstacle such as drifting wood or the like. The absorber valve 62 can feed the oil in the rod side chamber 31 to the liquid discharging chamber 60, and can extend the piston rod 22 and the piston 23 so as to raise the propulsion unit main body 15 up. The return valve 63 can be opened when the oil in the liquid discharging chamber 60 is increased to a level equal to or more than a predetermined value via the piston side chamber 32 and the pressure accumulating chamber 50 under application of an empty weight of the propulsion unit main body 15 tilted up after absorbing the impact force generated by the collision with the obstacle. Oil in the liquid discharging chamber 60 can return to the rod side chamber 31, and can compress the piston rod 22 and the piston 23 so as to return the propulsion unit main body 15 to a position before rising up. The free piston 61 is brought into contact with the end surface of the rod guide 24 so as to make the capacity of the liquid discharging chamber 60 zero before absorbing the impact force. The free piston 61 moves apart from the end surface of the rod guide 24 at a degree corresponding to the capacity of the oil which the absorber valve 62 feeds from the rod side chamber 31 for absorbing the impact force (the capacity of the liquid discharging chamber 60 becomes the capacity of the oil). The free piston 61 returns all of the oil from the return valve 63 to the rod side chamber 31 after absorbing the impact force so as to be brought into contact with the end surface of the rod guide 24. Further, the free piston 61 returns the piston rod 22 and the piston 23 to the position before absorbing the impact force and coincides the return position of the propulsion unit main body 15 with the staying position before jumping up.

In this case, the tilt device 20 is provided with an operating valve 64 (a spring bearing 64A, a spring 64B and a spring holder 64C) in the piston 23. The operating valve 64 is opened when the oil pressure in the piston side chamber 32 is increased to a level equal to or more than a predetermined value such as a case that a forward propelling force equal to or more than a predetermined value is applied under a condition of shipping over a shoal in which the propulsion unit main body 15 is kept at an optional middle tilt position. Accordingly, the piston rod 22 moves forward to the cylinder 21 so as to be compressed, and the propulsion unit main body 15 is downed to a down position and becomes a normal shipping state.

A description will be given below of contents of the operation of the tilt device 20.

(A) Normal Shipping

A description will be given of a reverse lock state keeping the tilt device 20 at a tilt down position shown in FIG. 5 at a normal shipping time. In this case, the operating portion 47 of the tilt operating apparatus 40 sets the switching valve 42 to a closed position, and the propulsion unit main body 15 abuts the front end portion of the swivel bracket 14 to the forward movement keeping portion of the clamp bracket 12, whereby the propulsion unit main body 15 is kept at the normal shipping position.

In the case of setting the propulsion unit main body 15 to the normal shipping position and shipping forward, the forward movement propelling force is supported by the forward movement keeping portion of the clamp bracket 12, and the tilt device 20 is held at the tilt down position. On the other hand, at a rearward shipping time, a tensile force is applied to the piston rod 22 due to the rearward movement propelling force and the pressure of the rod side chamber 31 is increased, however, the absorber valve 62 is not opened by the pressure increased of this degree, and the tilt device 20 is held at the tilt down position.

(B) Shipping over Shoal

Figure 5:
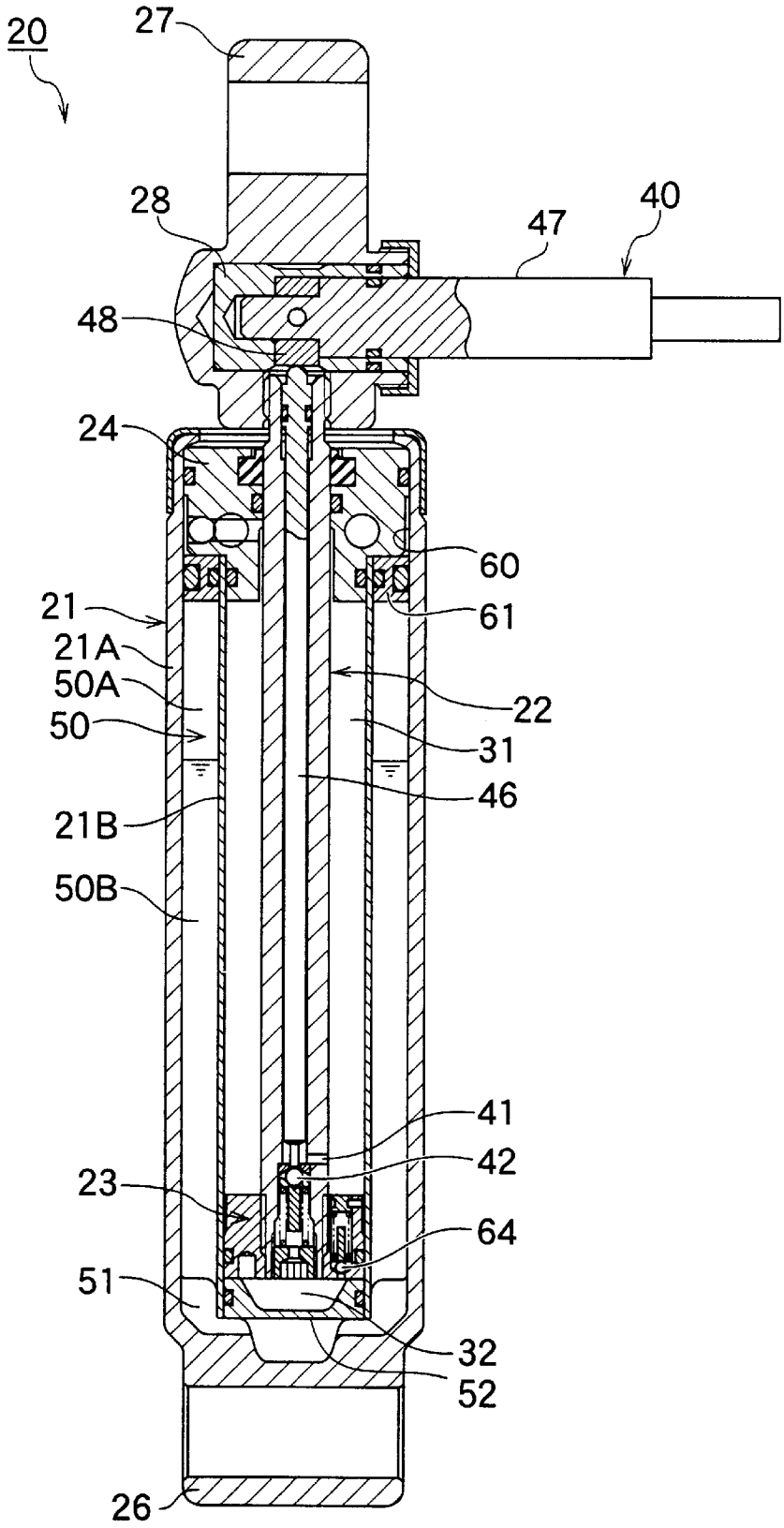
FIG. 5 is a cross sectional view showing a tilt down state.
Figure 6:
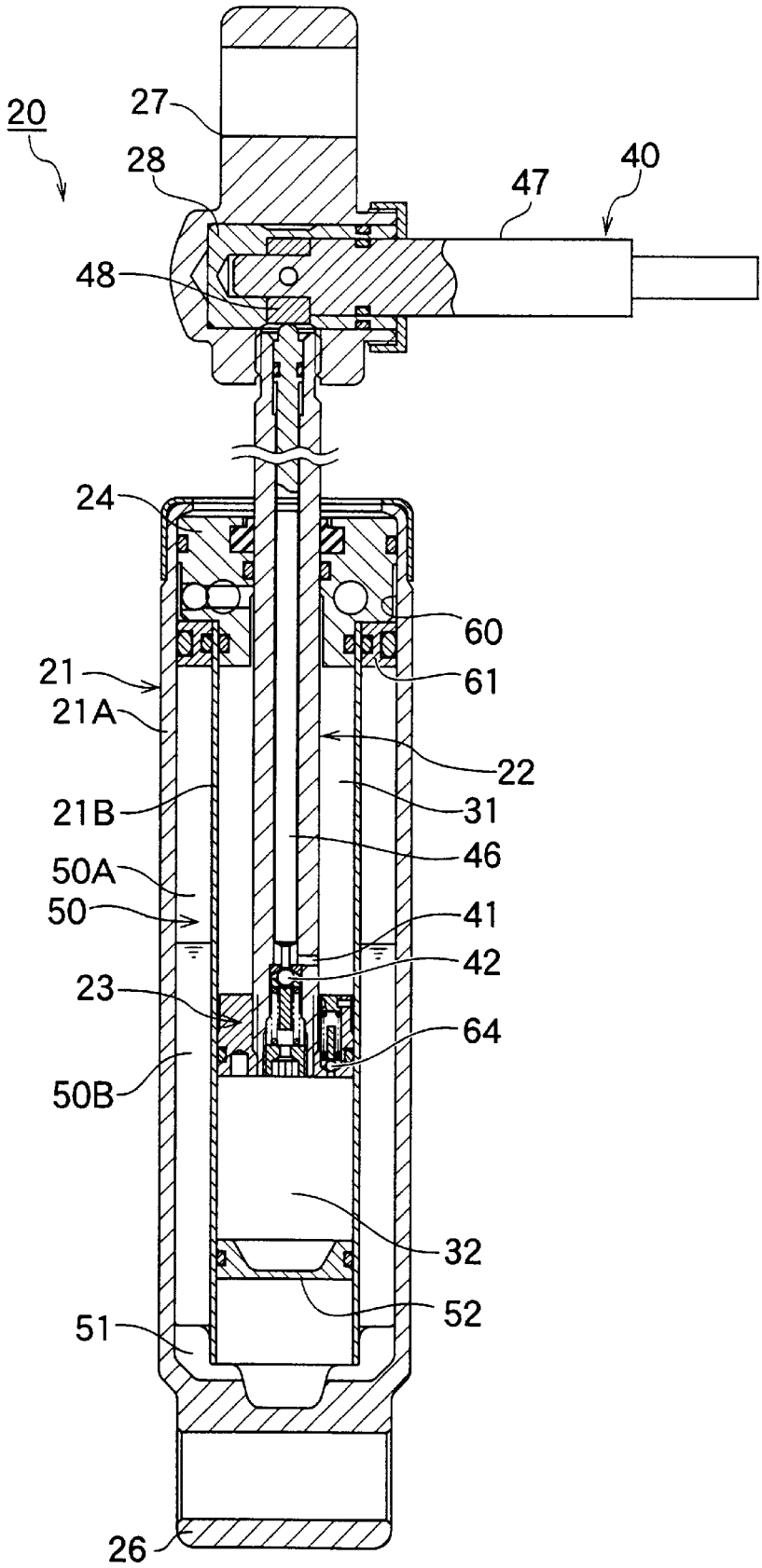
FIG. 6 is a cross sectional view showing a middle tilt state.

In shipping over the shoal, it is necessary to change the tilt device 20 from a tilt down position shown in FIG. 5 to a middle tilt position shown in FIG. 6 so as to prevent the propulsion unit main body 15 from hitting the bottom of the sea or river. In this case, the switching valve 42 is opened by the operating portion 47 of the tilt operating apparatus 40 in the manner mentioned above so as to communicate the rod side chamber 31 with the piston side chamber 32. Accordingly, the piston rod 22 and the piston 23 freely move in a vertical direction with respect to the cylinder 21. Therefore, it is possible to manually set the propulsion unit main body 15 to a desired middle tilt position. At this time, the gas pressure in the pressure accumulating chamber 50 assists the tilt-up load as mentioned above, whereby the tilt-up operation can be easily performed.

The piston rod 22 and the piston 23 are in an unmovable tilt lock state with respect to the cylinder 21 by closing the switching valve 42 in accordance with the operating portion 47 of the tilt operating apparatus 40 in a state of setting the propulsion unit main body 15 to the middle tilt position so as to make the rod side chamber 31 not communicated with the piston side chamber 32. Accordingly, it is possible to ship over the shoal. In this case, at a time of landing the hull, it is possible to set the propulsion unit main body 15 to the middle tilt position in the same manner as mentioned above.

In this case, in order to again position the propulsion unit main body 15 at the tilt-down position, the switching valve 42 is again opened by the operating portion 47 of the tilt operating apparatus 40 so that the propulsion unit main body 15 slowly returns to the tilt-down position due to the empty weight.

(C) Collision of Drifting Wood at Rearward Shipping over Shoal

If an obstacle such as drifting wood or the like collides with the propulsion unit main body 15 and an impact force directed towards a front portion of the hull is applied to the lower portion of the propulsion unit main body 15 at a time of rearward shipping over the shoal in a state of setting the tilt device 20 to the middle tilt position shown in FIG. 6, the compressing force is applied to the piston rod 22, and the pressure of the oil in the piston side chamber 32 is increased. When the oil pressure reaches a level equal to or more than a predetermined value, the operating valve 64 provided in the piston 23 is opened so as to absorb the impact, the piston rod 22 enters into the cylinder 21 so as to be compressed, and the propulsion unit main body 15 is downed in a tilt-down direction.

(D) Change from Shipping over Shoal to Normal Shipping

In the case of setting the tilt device 20 to the middle tilt position shown in FIG. 6 so as to ship over the shoal and thereafter ship offshore and change the propulsion unit main body 15 to the tilt-down position to perform a normal shipping, the forward propelling force of the propulsion unit main body 15 is increased. The propulsion unit main body 15 is applied a force forward the hull due to the propelling force, so that a compressing force is applied to the piston rod 22 and the pressure of the oil in the piston side chamber 32 is increased. When the oil pressure reaches a level equal to or more than a predetermined value, the operating valve 64 provided in the piston 23 is opened, the piston rod 22 enters into the cylinder 21 so as to be compressed, and the propulsion unit main body 15 is positioned at the tilt-down position.

(E) Collision of Drifting Wood at Forward Shipping

If an obstacle such as drifting wood or the like collides with the propulsion unit main body 15 and an impact force directed to a rear portion of the hull is applied to the lower portion of the propulsion unit main body 15 when shipping forward with the tilt device 20 set to the tilt-down position shown in FIG. 5 or the middle tilt position shown in FIG. 6, the tensile force is applied to the piston rod 22, and the pressure of the oil in the rod side chamber 31 is increased.

Figure 7:
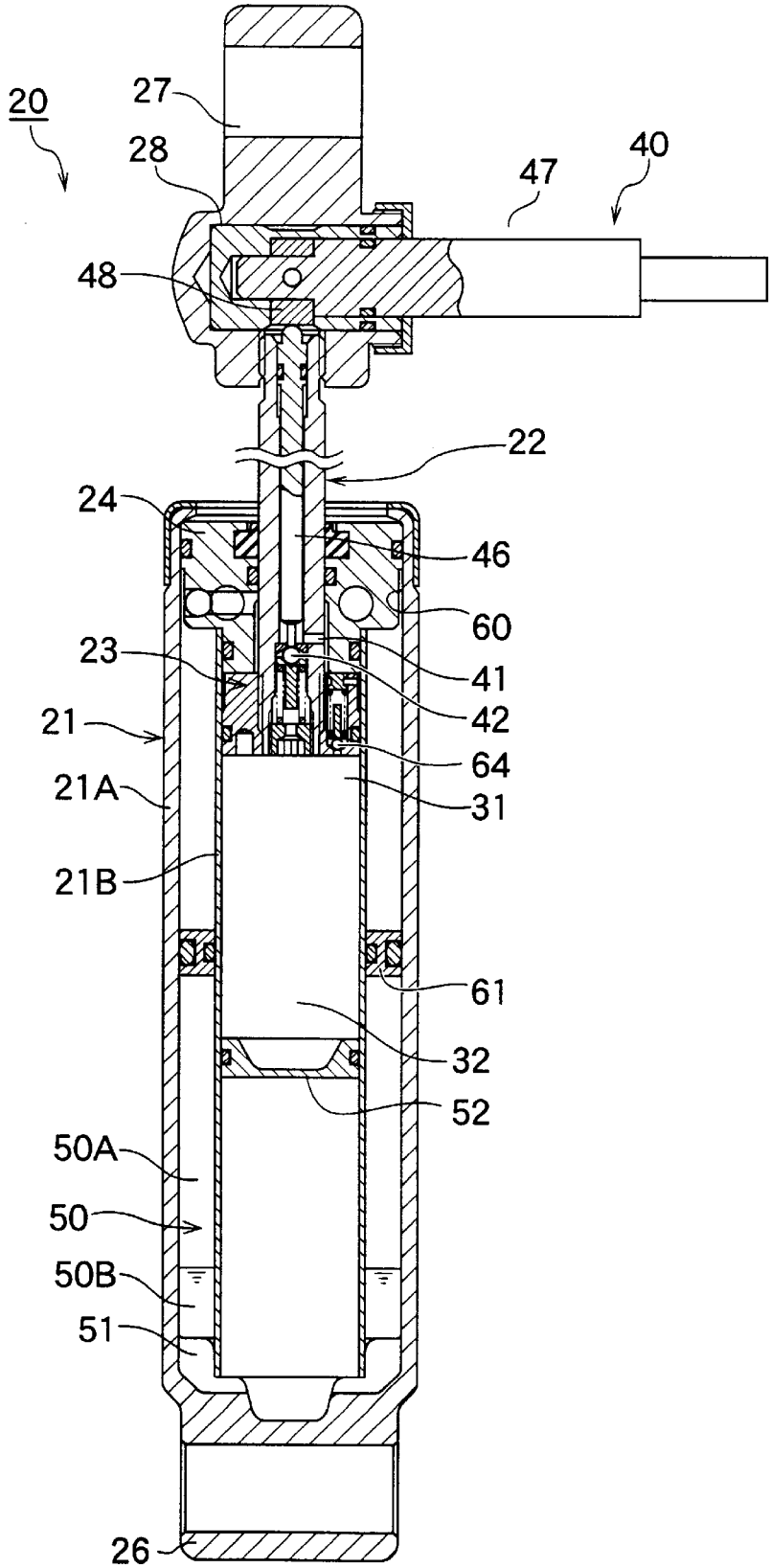
FIG. 7 is a cross sectional view showing a tilt up state.
Figure 8:
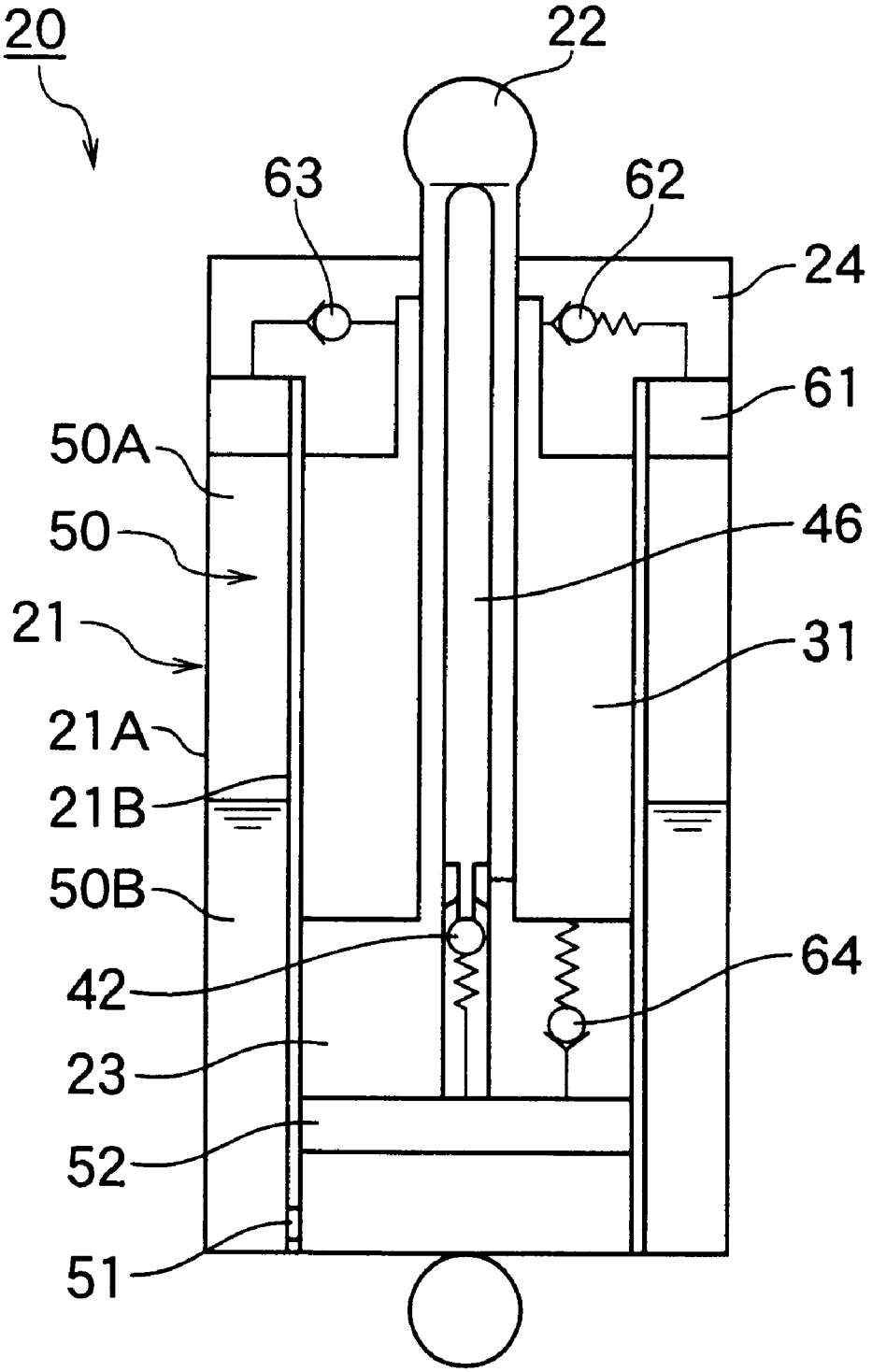
FIG. 8 is a schematic view showing a hydraulic circuit.

When the oil pressure reaches a level equal to or more than a predetermined value, the absorber valve 62 provided in the rod guide 24 is opened so as to absorb the impact force, the piston rod 22 moves out of the cylinder 21 so as to be expanded, the tilt device 20 is upped to the tilt-up position shown in FIG. 7, and the propulsion unit main body 15 is jumped up. At this time, the oil which the absorber valve 62 discharges from the rod side chamber 31 is fed to the liquid discharging chamber 60, and the free piston 61 moves apart from the end surface of the rod guide 24 at a degree corresponding to the capacity of the oil.

After the propulsion unit main body 15 is jumped up, the pressure of the piston side chamber 32 is increased due to the empty weight of the tilted-up propulsion unit main body 15, and the pressure increases the pressure in the liquid discharging chamber 60 via the pressure accumulating chamber 50. When the pressure in the liquid discharging chamber 60 is increased to a level equal to or more than a predetermined value, the return valve 63 is opened so as to return the oil in the liquid pressure chamber 60 to the rod side chamber 31. Accordingly, when the free piston 61 is brought into contact with the end surface of the rod guide 24, the absorber valve 62 returns all of the oils fed to the liquid discharging chamber 60 due to the impact absorption to the rod side chamber 31, so that the tilt device 20 returns to the position before absorbing the impact, and the propulsion unit main body 15 returns to the position before jumping up.

In accordance with the present embodiment, the following effects can be obtained.

(1) Since the pressure accumulating chamber 50 is formed in the space between the outer cylinder 21A and the inner cylinder 21B in the cylinder 21, it is possible to form the pressure accumulating chamber 50 with a large capacity in a wide range in a longitudinal direction of the cylinder 21, and the capacity of the pressure accumulating chamber 50 can be increased while the tilt device 20 is compact, whereby a gas assist performance can be improved.

(2) Since the free piston 52 corresponding to the liquid-gas separating means is interposed between the pressure accumulating chamber 50 and the piston side chamber 32, the gas in the pressure accumulating chamber 50 does not feed to the piston side chamber 32 and further to the rod side chamber 31 through the switching valve 42 even when the tilt device 20 takes any mounting attitude such as a normal or reverse position. Accordingly, the pressure accumulating chamber 50 can maintain a sufficient gas capacity, no gas is mixed to the working fluid in the piston side chamber 32 and the rod side chamber 31, and it is possible to secure a stable gas assist function at a time of opening the switching valve 42 and secure a stable tilt-lock function at a time of closing the switching valve 42. That is, it is possible to secure an improved operability while keeping a freedom in the mounting direction.

(3) The absorber valve 62 and the return valve 63 are in the rod guide 24 and have a diameter larger than that of the piston 23 in the complex cylinder type cylinder 21. Accordingly, since it is possible to receive the absorber valve 62 and the return valve 63 in the rod guide 24 with room without increasing the diameter of the rod guide 24 and it is possible to make the diameter of the piston 23 small, it is possible to jump up the propulsion unit main body 15 against the collision of drifting wood while making the cylinder 21 small-diameter and compact.

(4) In connection with the matter that the absorber valve 62 and the return valve 63 are provided in the rod guide 24, the free piston 61 for coinciding the returning position after jumping up of the propulsion unit main body 15 with the staying position before rising up is provided in the space between the outer cylinder 21A and the inner cylinder 21B in the cylinder 21. The liquid discharging chamber 60 for the fluid discharged from the absorber valve 62 is formed in the rod guide 24 side from the free piston 61 in the space. Accordingly, it is possible to coincide the returning position of the propulsion unit main body 15 jumped up due to the collision of drifting wood with the staying position before rising up.

(5) Since the switching valve 42 is provided in the piston rod 22 or the piston 23 and the operating portion 47 of the switching valve 42 is provided in the portion protruding from the cylinder 21 of the piston rod 22, it is possible to reduce a lateral size of the tilt device 20 and make the tilt device 20 compact.

(6) Since the absorber valve 62 and the return valve 63 in the items (3) and (4) are not provided in the piston rod 22 or the piston 23 but in the rod guide 24 at a time of providing the switching valve 42 in the piston rod 22, it is possible to easily place the switching valve 42 without increasing the diameter of the piston 23.

As heretofore explained, embodiments of the present invention have been described in detail with reference to the drawings. However, the specific configurations of the present invention are not limited to the embodiments but those having a modification of the design within the range of the present invention are also included in the present invention.

As mentioned above, in accordance with the present invention, the tilt device for a marine propulsion unit provided with a gas assist function can increase the capacity of a pressure accumulating chamber while being compact and can secure a jump-up performance of a propulsion unit main body caused by a collision with drifting wood.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A tilt device for a marine propulsion unit comprising:

a cylinder connected to one of a hull and a main body of a propulsion unit which is arranged and constructed to receive a working fluid;

a piston rod being connected to the other of the hull and the main body of the propulsion unit and being insertable into the cylinder so as to freely compress and expand;

a piston connected to an inserted end of the piston rod, and defining a rod side chamber in a side which does not receive a piston rod within the cylinder;

a switching valve capable of communicating the rod side chamber with the piston side chamber; and a pressure accumulating chamber capable of applying a gas pressure to the piston side chamber, wherein the cylinder has a double pipe having an outer cylinder and an inner cylinder, the piston rod and the piston are received in the inner cylinder, a rod guide supporting the piston rod seals the outer cylinder and the inner cylinder at an end portion of the cylinder, a free piston is arranged in a space between the outer cylinder and the inner cylinder, the pressure accumulating chamber is formed in a opposite rod guide side to the free piston in said space, a liquid discharging chamber is formed in a rod guide side, and an absorber valve which can be opened at a time when a pressure of a fluid in the rod side chamber is increased to a level equal to or more than a predetermined value and can feed the fluid in the rod side chamber to the liquid discharging chamber and a return valve which can be opened at a time when the pressure of the fluid in the liquid discharging chamber is increased to a level equal to or more than a predetermined value and can feed the fluid in the liquid discharging chamber to the rod side chamber are provided in the rod guide.

2. A tilt device for a marine propulsion unit as claimed in claim 1, wherein said switching valve is provided in the piston rod or the piston, a switching operation rod operating said switching valve is installed in the piston rod, and an operating portion of said switching operation rod is provided in a portion protruding from the cylinder of the piston rod.

3. A tilt device for a marine propulsion unit as claimed in claim 1, wherein a gas-liquid separating means is arranged between said pressure accumulating chamber and the piston side chamber.

4. A tilt device for a marine propulsion unit as claimed in claim 2, wherein a gas-liquid separating means is arranged between said pressure accumulating chamber and the piston side chamber.

5. A tilt device for a marine propulsion unit as claimed in claim 3, wherein said gas-liquid separating means is a free piston.

6. A tilt device for a marine propulsion unit as claimed in claim 4, wherein said gas-liquid separating means is a free piston.

7. A tilt device for a marine propulsion unit as claimed in claim 1, wherein a communicating passage communicating the piston side chamber with the rod side chamber is provided in an inserted end side to the inner cylinder of said piston rod, and said switching valve is provided in the communicating passage.

8. A tilt device for a marine propulsion unit as claimed in claim 2, wherein a communicating passage communicating the piston side chamber with the rod side chamber is provided in an inserted end side to the inner cylinder of said piston rod, and said switching valve is provided in the communicating passage.

* * * * *